US009270046B2

(12) United States Patent
Natoli et al.

(10) Patent No.: US 9,270,046 B2
(45) Date of Patent: Feb. 23, 2016

(54) SEAL FOR HELICAL CORRUGATED OUTER CONDUCTOR

(71) Applicant: John Mezzalingua Associates, LLC, East Syracuse, NY (US)

(72) Inventors: Christopher P. Natoli, Fulton, NY (US); Ian J Baker, Baldwinsville, NY (US)

(73) Assignee: John Mezzalingua Associates, LLC, Liverpool, NY (US)

( * ) Notice: Subject to any disclaimer, the term of this patent is extended or adjusted under 35 U.S.C. 154(b) by 287 days.

(21) Appl. No.: 13/957,531

(22) Filed: Aug. 2, 2013

(65) Prior Publication Data

US 2014/0045356 A1 Feb. 13, 2014

Related U.S. Application Data

(60) Provisional application No. 61/682,541, filed on Aug. 13, 2012, provisional application No. 61/788,112, filed on Mar. 15, 2013.

(51) Int. Cl.
*H01R 13/52* (2006.01)
*H01R 24/56* (2011.01)

(52) U.S. Cl.
CPC ..... *H01R 13/52* (2013.01); *H01R 13/5205* (2013.01); *H01R 24/564* (2013.01)

(58) Field of Classification Search
CPC ..... H01R 13/52; H01R 24/564; H01R 9/05
USPC ..... 439/578–584, 271–275
See application file for complete search history.

(56) References Cited

U.S. PATENT DOCUMENTS

| | | | | | |
|---|---|---|---|---|---|
| 4,260,966 | A * | 4/1981 | Boutros | 439/271 |
| 4,824,401 | A * | 4/1989 | Spinner | 439/584 |
| 5,267,877 | A * | 12/1993 | Scannelli et al. | 439/584 |
| 5,350,311 | A * | 9/1994 | Roy et al. | 439/273 |
| 5,354,217 | A * | 10/1994 | Gabel et al. | 439/583 |
| 5,561,900 | A * | 10/1996 | Hosler, Sr. | 29/828 |
| 5,951,327 | A * | 9/1999 | Marik | 439/607.44 |
| 6,267,621 | B1 | 7/2001 | Pitschi et al. | |
| 6,299,491 | B1 | 10/2001 | Bruce | |
| 6,939,169 | B2 | 9/2005 | Islam et al. | |
| 8,657,626 | B2 * | 2/2014 | Duval et al. | 439/583 |
| 8,766,110 | B2 * | 7/2014 | Daughtry et al. | 439/271 |
| 2004/0161970 | A1 * | 8/2004 | Wlos et al. | 439/578 |
| 2008/0020637 | A1 | 1/2008 | Montena | |

(Continued)

OTHER PUBLICATIONS

PCT/US2013/054749: International Search Report and Written Opinion; Date of Mailing: Jan. 10, 2014; 10 Pages.

(Continued)

*Primary Examiner* — Briggitte R Hammond
(74) *Attorney, Agent, or Firm* — Barclay Damon, LLP

(57) ABSTRACT

A seal member disposed within a coaxial cable connector comprising an annular body portion having an outer diameter surface and an inner diameter surface, and a plurality of flexible segments disposed along the inner diameter surface, extending radially inward from the inner diameter surface, wherein the flexible segments are configured to conform to a helical outer conductor and fill a valley of the helical outer conductor, thereby effectuating an environmental seal around the helical outer conductor is provided. A coaxial cable including the seal member is also provided. An associated method is further provided.

19 Claims, 10 Drawing Sheets

(56) References Cited

U.S. PATENT DOCUMENTS

| | | | | |
|---|---|---|---|---|
| 2010/0090459 | A1* | 4/2010 | Duquette et al. | 285/55 |
| 2010/0273340 | A1* | 10/2010 | Clausen | 439/277 |
| 2011/0042139 | A1* | 2/2011 | Duquette et al. | 174/84 R |
| 2012/0088404 | A1 | 4/2012 | Wild et al. | |
| 2012/0088405 | A1 | 4/2012 | Wild et al. | |
| 2012/0088406 | A1 | 4/2012 | Montena et al. | |
| 2013/0143439 | A1 | 6/2013 | Nugent et al. | |

OTHER PUBLICATIONS

PCT/US13/54521: International Search Report and Written Opinion; Date of Mailing: Oct. 10, 2013; 11 Pages.

* cited by examiner

SEAL FOR HELICAL CORRUGATED OUTER CONDUCTOR

CROSS-REFERENCE TO RELATED APPLICATIONS

This application is a non-provisional application claiming priority to and benefit of U.S. Provisional Application No. 61/682,541, filed Aug. 13, 2012, entitled "Seal For Helical Corrugated Outer Conductor," and U.S. Provisional Application No. 61/788,112, filed Mar. 15, 2013, and entitled "Coaxial Cable Connector Having A Seal Member For Sealing Around An Outer Conductor."

FIELD OF TECHNOLOGY

The following relates generally to the field of coaxial cable connectors and more particularly to a connector assembly having a seal for use with coaxial cables having a helical corrugated outer conductor.

BACKGROUND

Corrugated coaxial cables are electrical cables that are used as transmission lines for radio frequency signals. Coaxial cables are composed of an inner conductor surrounded by a flexible insulating layer, which in turn is surrounded by a corrugated outer conductor that acts as a conducting shield. An outer protective sheath or jacket surrounds the corrugated outer conductor.

A corrugated coaxial cable in an operational state typically has a connector affixed on either end of the cable. The quality of the electrical connection between the coaxial cable and the respective connectors is of utmost importance. Indeed, the quality of the electrical connection can either positively or negatively impact the resulting electric signal as well as the performance of the connector. One issue that negatively impacts the electric signal between the cable and the connector is environmental elements. The effectiveness of environmental sealing the connector depends on the mating of the internal seal of the connector to the helical corrugated outer conductor whose pitch and angle vary according to cable manufacturer. Currently, specifically-designed connectors must be chosen for each cable according to manufacturer. Moreover, even when the properly-sized connector is chosen for the designated cable, variations in the actual dimensions of the manufactured cable can lead to poor sealing between the connector and the outer conductor of the cable. Improperly-sized connectors, or even improperly-selected connectors for a particular cable, will negatively impact the environmental seal between the cable and the connector, resulting in moisture migration and extremely low performance.

Thus, there is a need in the field of helical corrugated coaxial cables for a universal connector that addresses the aforementioned problems.

SUMMARY

A first aspect relates to a seal member disposed within a coaxial cable connector comprising: an annular body portion having an outer diameter surface and an inner diameter surface; and a plurality of flexible segments disposed along the inner diameter surface, extending radially inward from the inner diameter surface, wherein the flexible segments are configured to conform to a helical outer conductor and fill a valley of the helical outer conductor, thereby effectuating an environmental seal around the helical outer conductor.

A second aspect relates to a coaxial cable connector comprising: a connector body having a first end and a second end, a clamp disposed within the connector body, the clamp having a cavity, a seal member disposed within the cavity of the clamp, the seal member having a plurality of flexible segments extending radially inwardly from an inner diameter surface of the seal member, and a compression member operably attached to the second end of the connector body, wherein axial compression of the compression body towards the connector body facilitates an environmental seal against an outer conductor of a coaxial cable.

A third aspect relates to a coaxial cable connector for assembly via axial compression to a helical corrugated coaxial cable having a helical corrugated outer conductor, the coaxial cable connector comprising: a connector body having a fastener end, a sealing member configured to overlap a helical corrugated outer conductor, the sealing member having a radial thickness and a ridge seal, the sealing member further having a flexible segment extending radially inward from the ridge seal, the flexible segment configured to extend into a helical groove of a helical corrugated outer conductor, and a compression member, the compression member axially advancing the sealing member relative to the connector body toward the fastener end of the connector body, wherein axial advancement of the compression member results in axial distortion of the sealing member and radial contact between the sealing member and the helical corrugated outer conductor.

A fourth aspect relates to a method of providing a seal around an outer conductor, comprising: disposing a seal member within a coaxial cable connector, wherein the seal member includes an annular body portion having an outer diameter surface and an inner diameter surface, and a plurality of flexible segments disposed along the inner diameter surface, extending radially inward from the inner diameter surface, and axially compressing the coaxial cable connector so that the plurality of flexible segments conform to a helical outer conductor and fill a valley of the helical outer conductor, thereby effectuating an environmental seal around the helical outer conductor.

A fifth aspect relates to a coaxial cable connector for assembly via axial compression to a helical corrugated coaxial cable having a helical corrugated outer conductor includes a connector body having a fastener end, a sealing member configured to overlap a helical corrugated outer conductor, the sealing member having a radial thickness and a ridge seal, the sealing member further having a flexible protrusion extending radially inward from the ridge seal, the flexible protrusion configured to extend into a helical groove of a helical corrugated outer conductor, and a compression member, the compression member axially advancing the sealing member relative to the connector body toward the fastener end of the connector body, wherein axial advancement of the compression member results in axial distortion of the sealing member and radial contact between the sealing member and the helical corrugated outer conductor.

A sixth aspect relates to coaxial cable connector for assembly via axial compression to a helical corrugated coaxial cable having a helical corrugated outer conductor includes a connector body having a fastener end, a sealing member configured to overlap a helical corrugated outer conductor; the sealing member having a radial thickness and a ridge seal, the sealing member further having a flexible protrusion extending radially inward from the ridge seal, the flexible protrusion configured to extend into a helical groove of a helical corrugated outer conductor, and a compression member, the compression member axially advancing the sealing member relative to the connector body toward the fastener end of the connector body, wherein axial advancement of the compression member results in axial distortion of the sealing member and radial contact between the sealing member and the helical corrugated outer conductor.

A seventh aspect relates to a coaxial cable connector for assembly via axial compression to a helical corrugated coaxial cable having a helical corrugated outer conductor includes a connector body having a fastener end, a sealing member configured to overlap a helical corrugated outer conductor; the sealing member having a radial thickness and a ridge seal, the sealing member further having a plurality of flexible protrusions extending radially inward from the ridge seal, the plurality of flexible protrusions configured to extend into a helical groove of a helical corrugated outer conductor, and a compression member, the compression member axially advancing the sealing member relative to the connector body toward the fastener end of the connector body, wherein axial advancement of the compression member results in axial distortion of the sealing member and radial contact between the sealing member and the helical corrugated outer conductor.

The foregoing and other features and advantages of the present disclosure will be apparent from the following more detailed description of the particular embodiments of the invention, as illustrated in the accompanying drawings.

BRIEF DESCRIPTION

Some of the embodiments will be described in detail, with reference to the following figures, wherein like designations denote like members, wherein.

DETAILED DESCRIPTION

Figure 1:
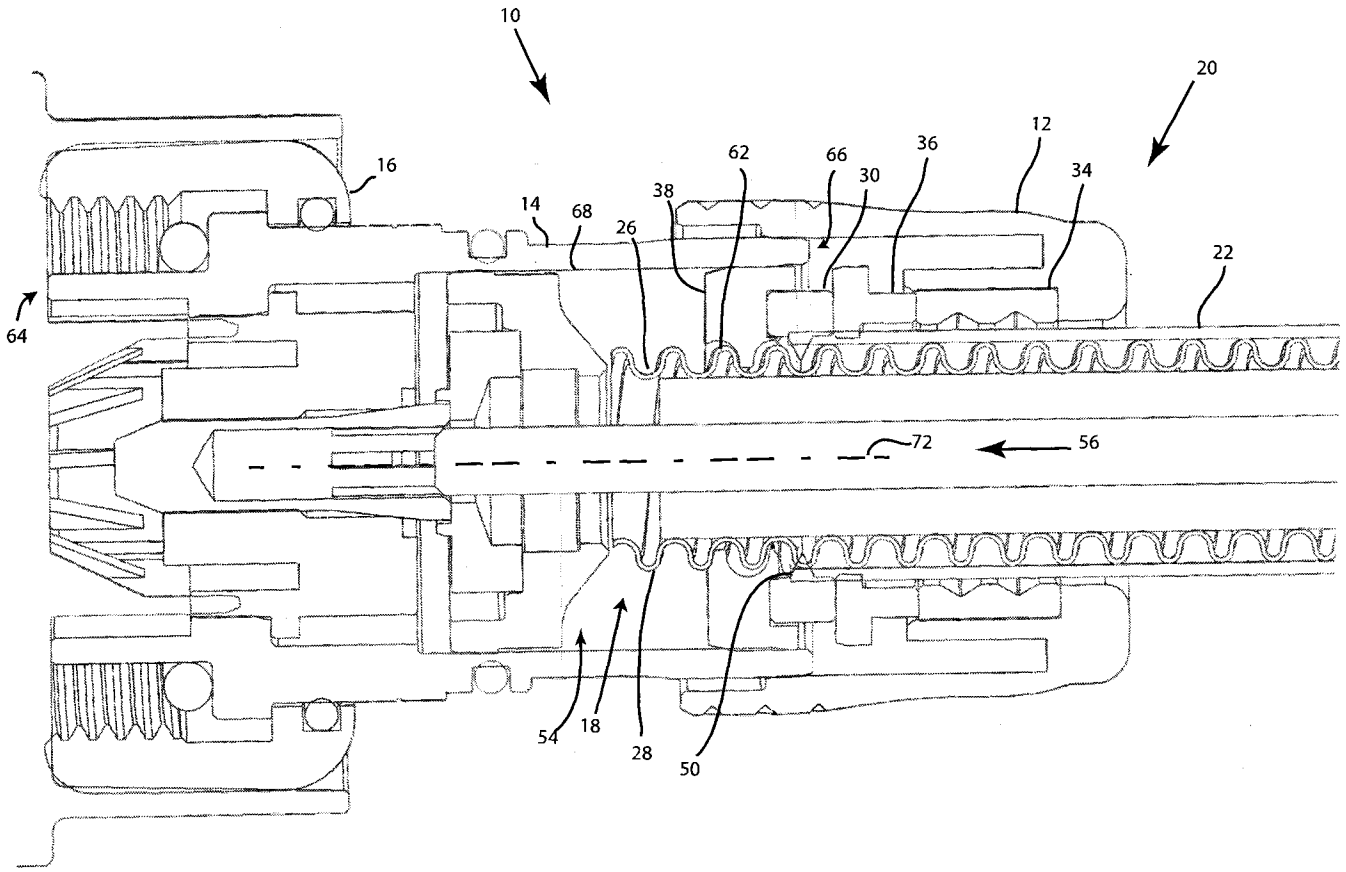
FIG. 1 is a cross-section of a connector for assembly to a prepared end of a helical, or spiral, corrugated coaxial cable and a partially inserted helical corrugated coaxial cable.
Figure 2:
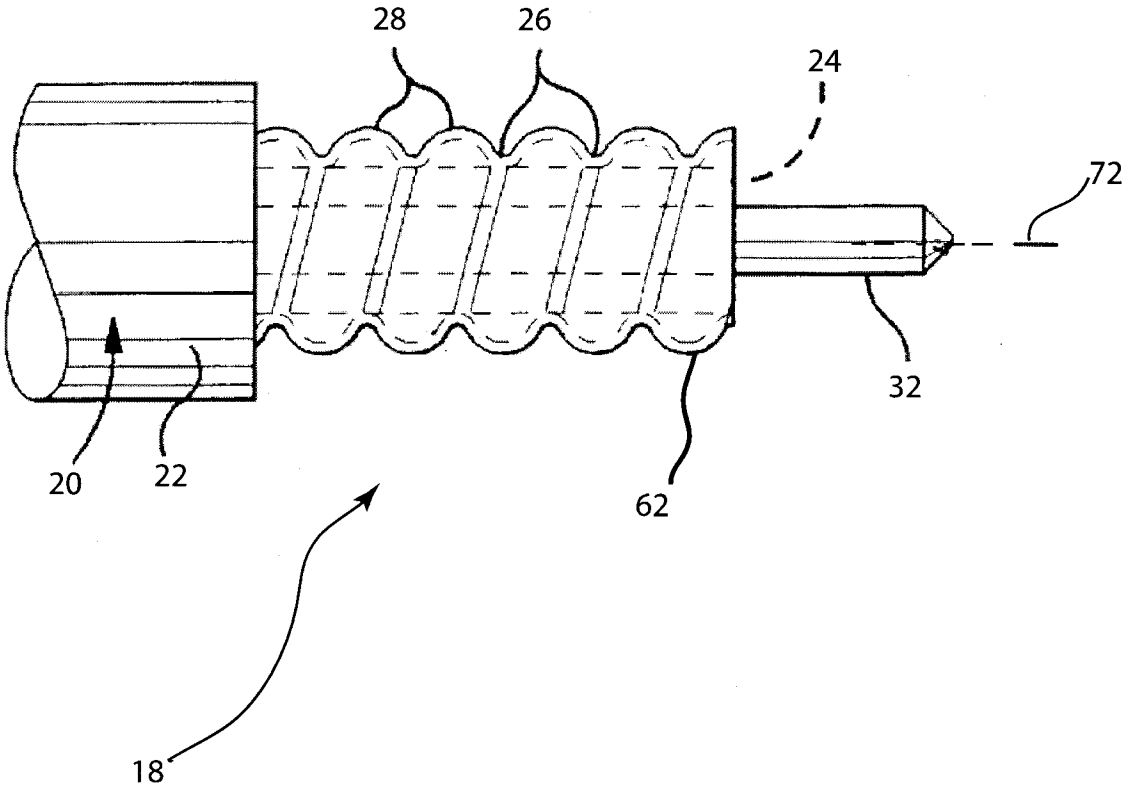
FIG. 2 is a partial length of a helical corrugated coaxial cable having a prepared end.

Referring first to FIGS. 1 and 2, one embodiment of the connector 10 and a helical, or spiral, corrugated coaxial cable 20 with a prepared end 18 are shown aligned on a common central axis 72. Since the connector 10 and the helical corrugated coaxial cable 20 are generally axially symmetric about their central axis 72, the "radially outward" direction in the following description is considered to be outwardly away from the central axis 72. Conversely, "radially inward" with respect to connector component motion is considered to be inwardly toward the central axis 72. Moreover, "axial advancement" of the cable 20 with respect to the connector 10 and "axial advancement" of components of the connector 10 with respect to one another is considered to be along the length of the axis 72.

With continued reference to FIG. 1, a cross-section of a connector 10 for assembly to a prepared end 18 of a helical, or spiral, corrugated coaxial cable 20 and a partially inserted helical corrugated coaxial cable 20 is shown. The connector 10 includes a compression member 12, a connector body 14, and a fastener member 16. The connector body 14 has a fastener end 64 and a cable end 66. The fastener member 16 may be rotatably attached to the fastener end 64 or the fastener member 16 may be integral to the fastener end 64, for example, the fastener end 64 may include an external threaded portion. The connector body 14 includes a body cavity 54 located at the second end 66. The body cavity 54 defines a cavity surface 68 within the connector body 14. The compression member 12 is slidably attached to the connector body 14 at the cable end 66. In the present embodiment, the compression member 12 overlaps the connector body 14 in such a way that is may slide axially along the connector body 14. Accordingly, the compression member 12 may axially drive physical and electrical cable attachment components as well as sealing components forward 56 into the body cavity 54. In other embodiments, the compression member 12 may slidably attach within the body cavity 54 or the compression member 12 may attach to the connector body 14 by threaded engagement or through a keyed joint. Whichever attachment means is employed, the attachment means allows for at least relative axial movement between the compression member 12 and the connector body 14.

The compression member 12 supports axial movement of components such as the jacket seal 34, the clamp push ring 36, the sealing member 30, and the clamp 38 into the body cavity 54. As these components are axially advanced forward 56 into the body cavity 54, the jacket seal 34 and the sealing member 30 are squeezed axially, producing axial distortion. The compression member 12 and/or the connector body 14 provide support to substantially limit radially outward expansion of the jacket seal 34 and the sealing member 30. In that way, the jacket seal 34 and the sealing member 30 expand radially inward when exposed to the compressive force of axial advancement 56. The arrangement of the components noted above is not necessary to achieve the result of radially inward expansion, or axial distortion, of the sealing member 30. Each component noted does not have to even be part of the assembly. Similarly, the listed components may be combined into hybrid components. For example, the clamp 38 and the sealing member 30 may be co-molded such that a single component is installed. Further, should be desired properties be available for sealing and clamping, the clamp 38 and the sealing member 30 may be combined into a single homogeneous part. It may be found that the sealing member 30 and the jacket seal 34 provide redundant results such that the jacket seal 34 is not necessary.

Referring to FIG. 2, a partial length of a helical corrugated coaxial cable 20 having a prepared end 18 is shown. The helical corrugated coaxial cable 20 that may be coupled to the connector 10 is comprised of a solid center conductor 32 surrounded by an insulator 24, a helical corrugated outer conductor 62 surrounding the insulator 24, and an insulating jacket 22 surrounding the helical corrugated outer conductor 62. The prepared end 18 of the helical corrugated coaxial cable 20 is comprised of an exposed length of the center conductor 32 and an exposed length of the helical corrugated outer conductor 62. The helical corrugation of the helical corrugated outer conductor 62 consists of a groove 26 and a ridge 28. The groove 26 and the ridge 28 are adjacent one another and follow a helical trajectory along the axial length of the helical corrugated outer conductor 62. The insulator 24 is made of a soft, flexible material, such as polymer foam. A portion of the insulator 24 may be removed from the prepared end 18, thereby providing a "cored out" annular cavity 46.

Figure 3:
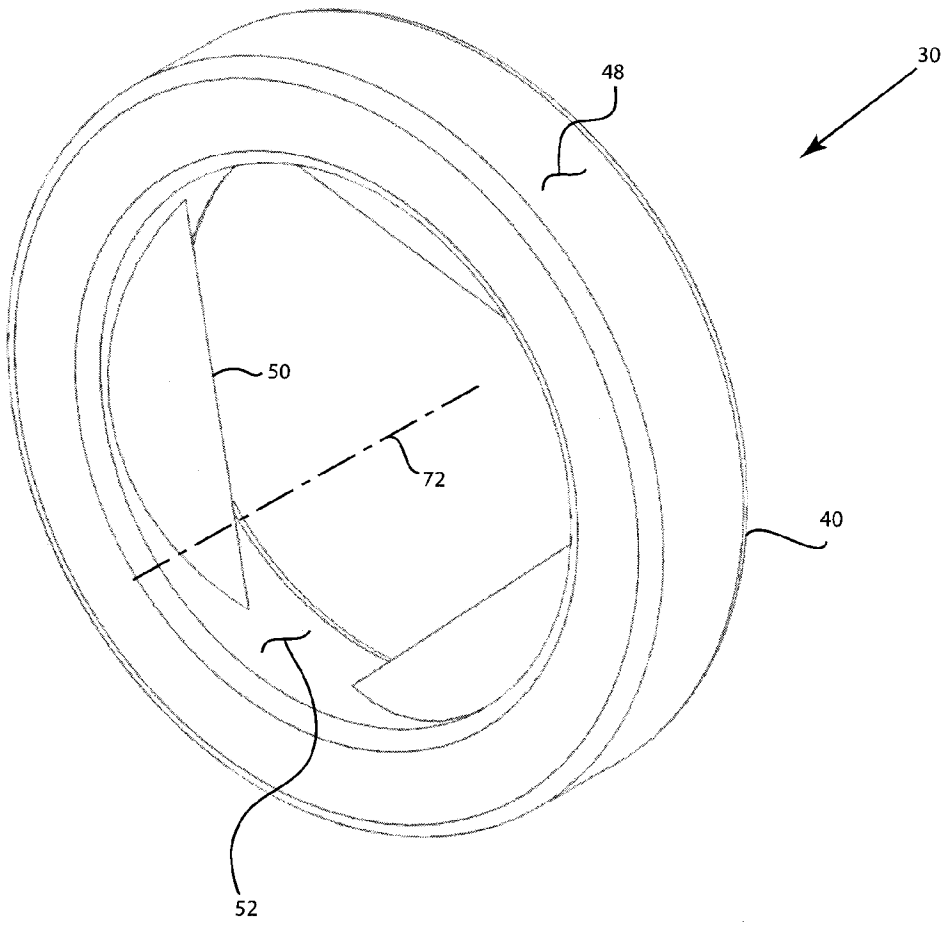
FIG. 3 is an isometric view of one embodiment of a sealing member.

Referring to FIG. 3, an isometric view of a sealing member 30 is shown. The sealing member 30 includes a ring 40 and a flexible protrusion 50. The ring 40 is a cylindrical feature configured to share a central axis 72 with the helical corrugated coaxial cable 20 and the coaxial cable connector 10. The ring 40 includes a cavity seal 48 and a ridge seal 52. The cavity seal 48 is a surface on the outermost boundary of the ring 40. The ridge seal 52 is a surface on the innermost surface of the ring 40. The cavity seal 48 and the ridge seal 52 are shown in FIG. 3 as smooth surfaces at constant radial distances along the axis 72. These characteristics may vary according to the desired application. For example, the cavity seal 48 may be tapered or may be a grooved surface. Further, the ridge seal 52 may have a varying radial distance over its axial length, such as a centrally located peak or valley. The flexible protrusion 50 extends radially inward from the ridge seal 52. The flexible protrusion 50 has an axial profile that becomes thinner at its radial extent than at its base at the ridge seal 52. In the illustration, the flexible protrusion 50 has a triangular profile, shown in FIG. 1. The profile may vary from the illustration in practice, being rounded or having a rectangular profile or otherwise configured to suit the specific application.

Referring again to FIG. 1, the sealing member 30 resides within the coaxial cable connector 10 at a location immediately adjacent the helical corrugated outer conductor 62. The sealing member 30 may reside at any axial location along the helical corrugated coaxial cable 20 where the insulating jacket 22 is removed from the helical corrugated outer conductor 62. The ridge seal 52 is located a radial distance from the axis 72 to overlap the ridge 28 of the helical corrugated outer conductor 62. In that way, the sealing member 30 may slide into position over the helical corrugated outer conductor 62. When the sealing member 30 is installed over the helical corrugated outer conductor 62, the flexible protrusion 50 extends into the groove 26 below the crest of the ridge 28. The flexible protrusion 50 flexes when it encounters the ridge 28 as the helical corrugated outer conductor 62 is assembled to the sealing member 30. The flexibility of the flexible protrusion 50 allows for a seal to be formed against the surface of the ridge 28 and/or the surface of the groove 26.

Figure 4:
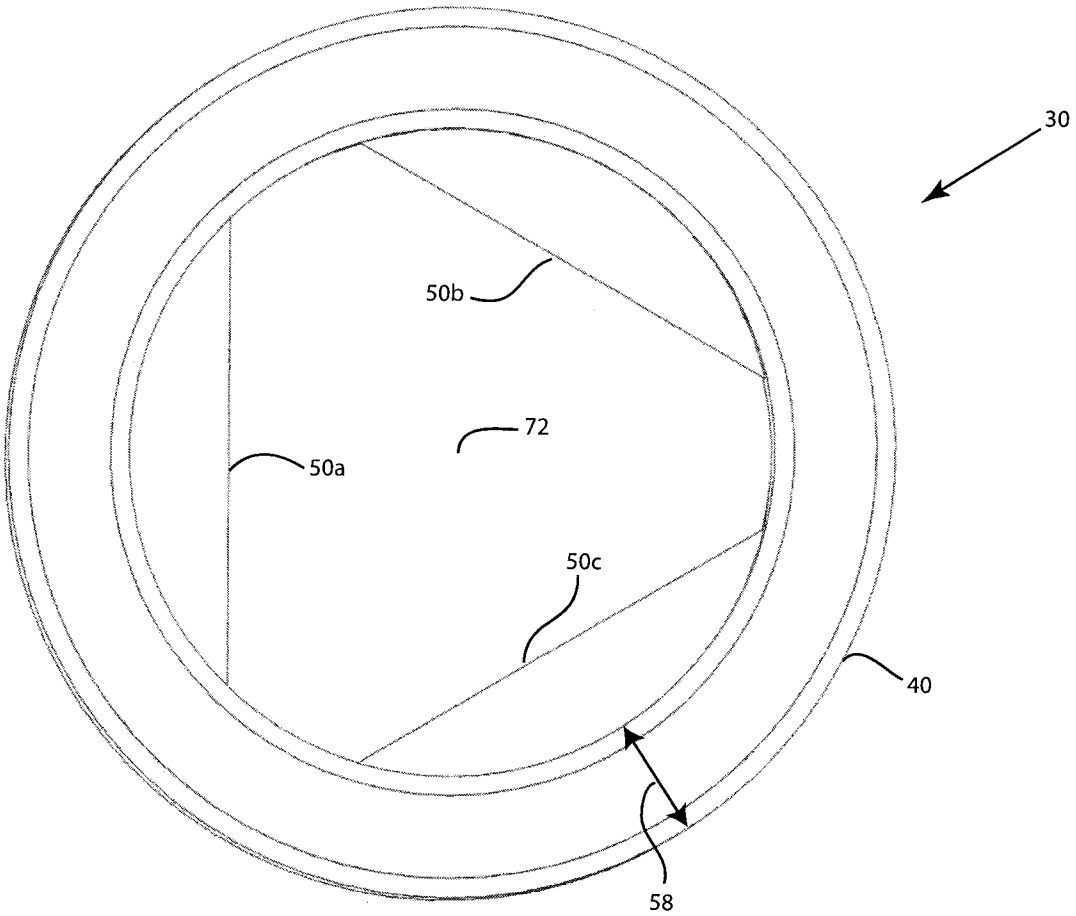
FIG. 4 is a plan view of the sealing member of FIG. 3.

Referring to FIG. 4, a plane view of the sealing member 30 having a plurality of flexible protrusions 50*a*, 50*b*, 50*c* is shown. In the illustration, there are three flexible protrusions 50*a*, 50*b*, 50*c*. When the helical corrugated outer conductor 62 passes through the sealing member 30 along the axis 72 the three protrusions 50*a*, 50*b*, 50*c* track the helical trajectory of the groove 26 and ridge 28. This creates a redundant sealing arrangement to prevent moisture from flowing along the groove 26 and passing the sealing member 30 and flowing into the coaxial cable connector 10. For example, at any given time one flexible protrusion 50*a* may be pressed firmly to seal against the ridge 28, while another flexible protrusion 50*b* makes sealing contact with the bottom of the groove 26, and yet another flexible protrusion 50*c* makes sealing contact at a transition between the groove 26 and the ridge 28. The ring 40 of the sealing member 30 has a radial thickness 58 that defines the radially outward extent of the sealing member 30 where the cavity seal 48 is located. The number of flexible protrusions 50 depends on designer preference according to the application. The flexible protrusion 50 may also be designed as a single unbroken protrusion about the entire ridge seal 52; however, such a design may perform better if provided with slits to relieve stress.

Figure 5:
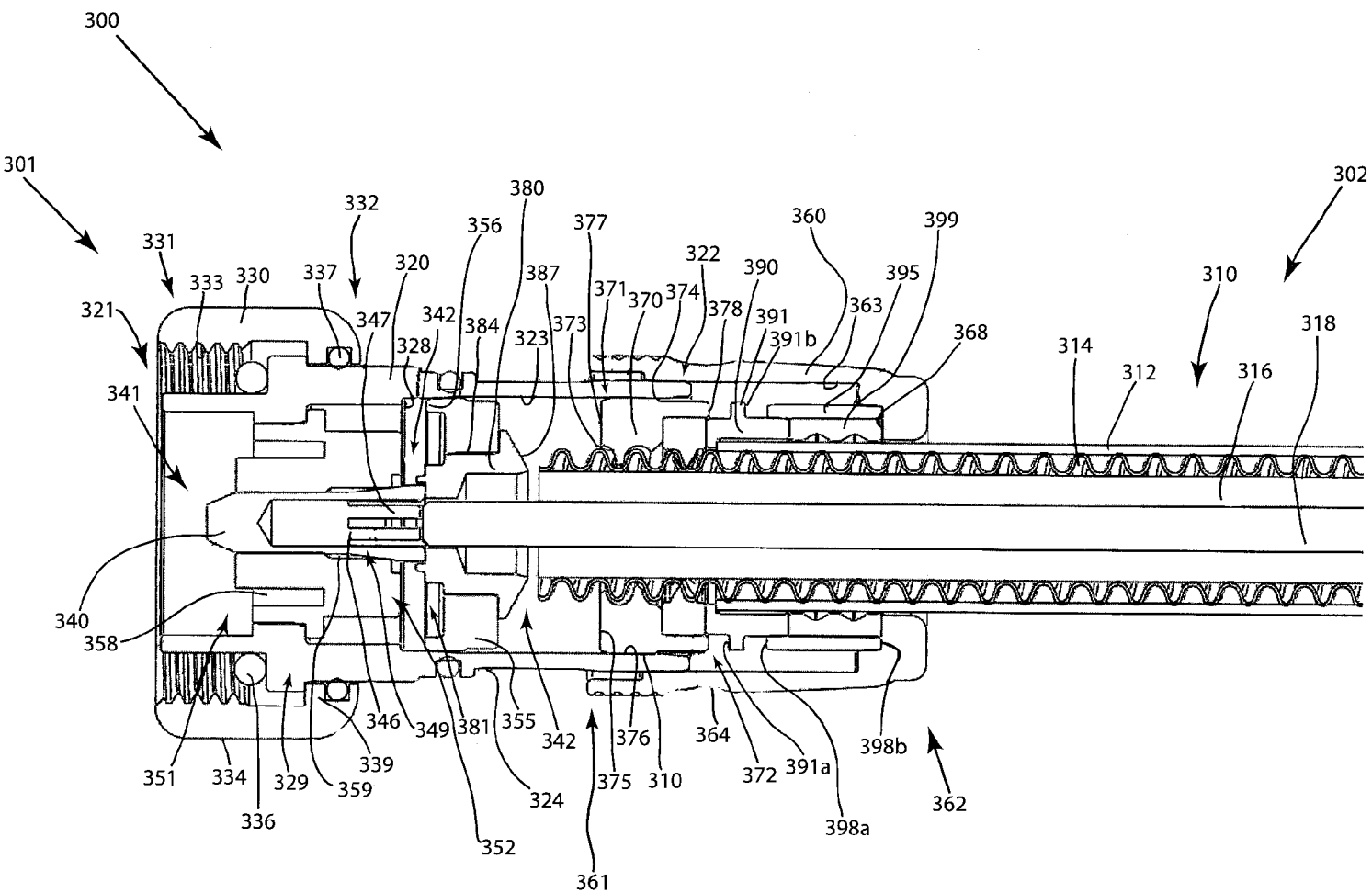
FIG. 5 depicts a cross-sectional view of an embodiment of a connector in an open position.

Referring still to the drawings, FIG. 5 depicts depict an embodiment of a connector 300. Connector 300 may be a straight connector, a right angle connector, an angled connector, an elbow connector, or any complimentary connector that may receive a center conductor 318 of a coaxial cable. Further embodiments of connector 300 may receive a center conductor 318 of a coaxial cable 310, wherein the coaxial cable 310 includes a corrugated, helical outer conductor 314. Connector 300 can be provided to a user in a preassembled configuration to ease handling and installation during use. Two connectors, such as connector 300 may be utilized to create a jumper that may be packaged and sold to a consumer. A jumper may be a coaxial cable 310 having a connector, such as connector 300, operably affixed at one end of the cable 310 where the cable 310 has been prepared, and another connector, such as connector 300, operably affixed at the other prepared end of the cable 310. Operably affixed to a prepared end of a cable 310 with respect to a jumper includes both an uncompressed/open position and a compressed/closed position of the connector while affixed to the cable. For example, embodiments of a jumper may include a first connector including components/features described in association with connector 300, and a second connector that may also include the components/features as described in association with connector 300, wherein the first connector is operably affixed to a first end of a coaxial cable 310, and the second connector is operably affixed to a second end of the coaxial cable 310. Embodiments of a jumper may include other components, such as one or more signal boosters, molded repeaters, and the like.

Figure 6A:
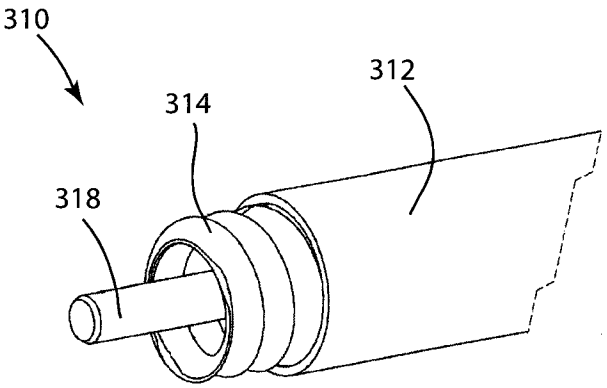
FIG. 6A depicts a perspective view of an embodiment of a coaxial cable.
Figure 6B:
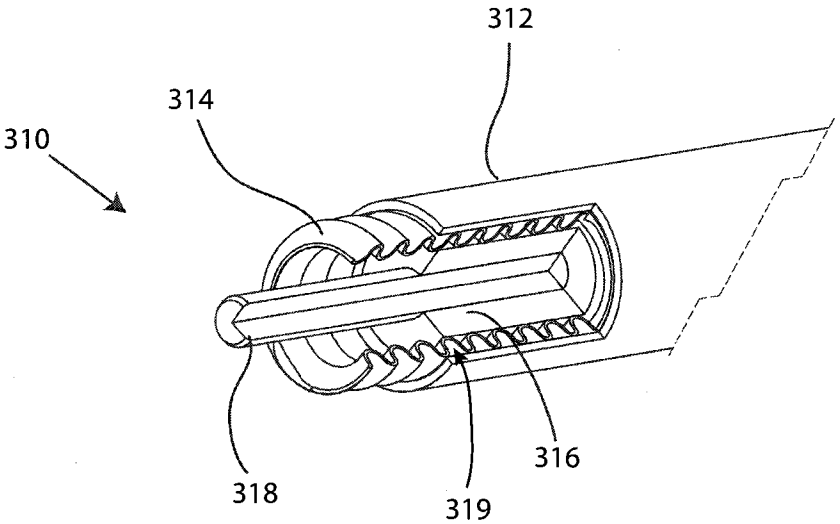
FIG. 6B depicts a perspective partial cut-away view of an embodiment of the coaxial cable.

Referring to FIGS. 6A and 6B, embodiments of a coaxial cable 310 may be securely attached to a coaxial cable connector. The coaxial cable 310 may include a center conductor 318, such as a strand of conductive metallic material, surrounded by an interior dielectric 316; the interior dielectric 316 may be surrounded by an outer conductor 314; the outer conductor 314 may be surrounded by a protective outer jacket 312, wherein the protective outer jacket 312 has dielectric properties and serves as an insulator. The outer conductor 314 may extend a grounding path providing an electromagnetic shield about the center conductor 318 of the coaxial cable 310. The outer conductor 314 may be a semi-rigid or rigid outer conductor of the coaxial cable 310 formed of conductive metallic material, and may be corrugated or otherwise grooved. For instance, the outer conductor 314 may be spiral or helical corrugated, sometimes known as Superflex® cable. Examples of spiral corrugated cable may include 50 ohm "Superflex" cable and 75 ohm "coral" cable. Spiral corrugated coaxial cable is a type of coaxial cable 310 that can be used in situations where a solid conductor may be necessary for shielding purposes, but may also be necessary for the cable to be highly flexible. Unlike standard coaxial cable, spiral corrugated coaxial cable has an irregular outer surface, which can make it difficult to design connectors or connection techniques in a manner that provides a high degree of mechanical stability, electrical shielding, and environmental sealing, but which does not physically damage the irregular outer surface of the cable. The coaxial cable 310 may be prepared by removing a portion of the protective outer jacket 312 so that a length of the outer conductor 314 may be exposed; an additional step may include coring out a portion of the dielectric 316 to create a cavity or space between the outer conductor 314 and jacket 312, and the center conductor 318. The protective outer jacket 312 can physically protect the various components of the coaxial cable 310 from damage that may result from exposure to dirt or moisture, and from corrosion. Moreover, the protective outer jacket 312 may serve in some measure to secure the various components of the coaxial cable 310 in a contained cable design that protects the cable 310 from damage related to movement during cable installation. The outer conductor 314 can be comprised of conductive materials suitable for carrying electromagnetic signals and/or providing an electrical ground connection or electrical path connection. Various embodiments of the outer conductor layer 314 may be employed to screen unwanted noise. The dielectric 316 may be comprised of materials suitable for electrical insulation. The protective outer jacket 312 may also be comprised of materials suitable for electrical insulation. It should be noted that the various materials of which all the various components of the coaxial cable 310 may have some degree of elasticity allowing the cable 310 to flex or bend. It should further be recognized that the radial thickness of the coaxial cable 310, protective outer jacket 312, outer conductor 314, interior dielectric 316, and/or center conductor 318 may vary based upon generally recognized parameters.

Referring back to FIG. 5, embodiments of connector 300 may include a coupling member 330, a connector body 320, an electrical contact 340, an insulator body 350, an insert 355, a ramped component 380, a clamp 370, a seal member 3110, a drive member 390, a collar 395, and a compression member 360.

Embodiments of connector 300 may include a connector body 320. Connector body 320 may include a first end 321, a second end 322, an inner surface 323, and an outer surface 324. Embodiments of the connector body 320 may include a generally axially opening therethrough. Embodiments of the connector body 320 may also include a retaining portion 329 proximate the first end 321 for rotatably engaging, or securably retaining, a coupling member 330. The retaining portion 329 may include an annular groove for retaining the coupling member 330. For instance, the retaining portion 329 facilitates the rotatable engagement of the coupling member 330 to the connector body 320. Proximate the second end 322 of the connector body 320, the inner diameter of the connector body 320 may be larger than the inner diameter of the connector body 320 proximate the first end 321. Moreover, the change in inner diameter of the axial opening of the connector body 320 may be gradually narrowing, or may be defined by a ramped surface somewhere along the inner surface 323 of the connector body 320, which can be an annular ramped surface that tapers inward towards the first end 321 of the connector body 320. For example, the inner surface 323 of the connector body 320 may have a surface feature, such as a ramped portion, that narrows the opening within the connector body 320 which can compress the clamp 370. In other words, the clamp 370 and potentially other internal components may be radially compressed when the components are slidably driven axially within the connector body. In addition, the connector body 320 may be formed of metals or polymers or other materials that would facilitate a rigidly formed body. Manufacture of the connector body 320 may include casting, extruding, cutting, turning, tapping, drilling, injection molding, blow molding, or other fabrication methods that may provide efficient production of the component. Those in the art should appreciate that various embodiments of the connector body 320 may also comprise various inner or outer surface features, such as annular grooves, detents, tapers, recesses, and the like, and may include one or more structural components having insulating properties located within the connector body 320.

Referring still to FIG. 5, embodiments of connector 300 may include a coupling member 330. The coupling member 330 may include a first end 331, a second end 332, an inner surface 333, and an outer surface 334. Embodiments of the coupling member 330 may be a coupling member configured to mate with a corresponding port, or other connector; the coupling member 330 may include internal threads along the inner surface 333 to threadably mate with a port. The coupling member 330 may include a generally axial opening extending from the first end 331 to the second end 332. Proximate the second end 332, the coupling member 330 may include an annular lip 339 configured to cooperate with the retaining portion 329 of the connector body 320, such that the coupling member 330 may rotate about the connector body 320 yet is retained in the axial direction with respect to the connector body 320, as known to those having skill in the art. A first sealing member 336, such as an O-ring or other rubber deformable ring, may be placed within the annular groove of the connector body 320 to form an environmental seal. A second sealing member 337, such as an O-ring or other rubber deformable sealing member, may be placed within the axial opening of the coupling member 330 and against the internal lip 339 of the coupling member 330 to form yet another environmental seal. Those having skill in the art should appreciate that additional sealing members may be placed at various locations proximate the coupling member 330 to prevent moisture migration or other ingress of environmental elements. Further, embodiments of the coupling member 330 may include external threads for threaded engagement to another connector, equipment port, splice, etc. For instance, embodiments of the coupling member 330 may be a male-type interface, but may also be a female-type interface, potentially having a rotatable coupling element, such as a nut, for threadable connections. In addition, the coupling member 330 may be formed of metals or polymers or other materials that would facilitate a rigidly formed body. Manufacture of the coupling member 330 may include casting, extruding, cutting, turning, tapping, drilling, injection molding, blow molding, or other fabrication methods that may provide efficient production of the component. Those in the art should appreciate that various embodiments of the coupling member 330 may also comprise various inner or outer surface features, such as annular grooves, detents, tapers, recesses, and the like, and may include one or more structural components having insulating properties located within the coupling member 330.

With continued reference to FIG. 5, embodiments of connector 300 may include an electrical contact 340. Contact 340 may include a first end 341 and a second end 342. Contact 340 may be a conductive element that may extend or carry an electrical current and/or signal from a first point to a second point. Contact 340 may be a terminal, a pin, a conductor, an electrical contact, a curved contact, a bended contact, an angled contact, and the like. Embodiments of the contact 340 can be formed of conductive materials. Moreover, embodiments of contact 340 may include a socket 346 proximate or otherwise near the first end 341. The socket 346 may be a conductive center conductor clamp or basket that clamps, grips, collects, receives, or mechanically compresses onto the center conductor 318. The socket 346 may further include an opening 349, wherein the opening 349 may be a bore, hole, channel, and the like, that may be tapered. The socket 346, in particular, the opening 349 of the socket 346 may accept, receive, and/or clamp an incoming center conductor 318 of the coaxial cable 310 as a coaxial cable 310 is further inserted into the connector body 320 to achieve a closed position. The socket 346 may include a plurality of engagement fingers 347 that may permit deflection and reduce (or increase) the diameter or general size of the opening 349. In other words, the socket 346 of contact 340 may be slotted or otherwise resilient to permit deflection of the socket 346 as the coaxial cable 310 is further inserted into the connector body 320 to achieve a closed position, or as the compression member 360 is axially displaced further onto connector body 320.

Referring still to FIG. 5, embodiments of connector 300 may include an insulator body 350. The insulator body 350 may include a first end 351, a second end 352, an inner surface 353, and an outer surface 354. The insulator body 350 may be disposed within the connector body 320, wherein the insulator body 350 surrounds or substantially surrounds at least a portion of contact 340. The insulator body 350 may electrically isolate the contact 340 from the connector body 320. Embodiments of the insulator body 350 may also include one or more axial slots 358 to allow deflection of the insulator body 350, which can add stability in supporting the contact 340. Moreover, the insulator body 350 may include an axially extending opening 359 which may extend from the first end 351 through the second end 352. The opening 359 may be a bore, hole, channel, tunnel, and the like. The insulator body 350, in particular, the opening 359 of the insulator body 350, may accept, receive, accommodate, etc., the axially displaced electrical contact 340 as a coaxial cable 310 is further inserted into the connector body 320. Embodiments of the insulator body 350 can be made of non-conductive, insulator materials. Manufacture of the insulator body 350 may include casting, extruding, cutting, turning, drilling, compression molding, injection molding, spraying, or other fabrication methods that may provide efficient production of the component.

Embodiments of connector 300 may further include a ramped component 380. The ramped component 380 may have first end 381 and a second end 382, and may have a general axial opening therethrough. For instance, the ramped component 380 may be a generally annular member having a ramped, compression surface 387 proximate the second end 382. Embodiments of the ramped component 380 may not be press-fit to a location within the connector body 320 during assembly of the connector 300, wherein the first end 381 of the ramped component 380 engages the contact 340. However, in alternative embodiments, the ramped component 380 is configured to be axially displaced within the connector body 320 in a direction towards the first end 301 of the connector 300 during axial compression of the compression member 360 to achieve a closed position. The ramped surface 387 may be an annular tapered portion of the ramped component 380. The ramped surface 387 may also be referred to as a first surface, or first compression surface, wherein the first surface may be configured to receive a portion of the outer conductor 314 of the coaxial cable 310 to flare it out, or otherwise physically engage, and clamp the outer conductor 314 against a second compression surface, such as a forward, surface 377 of the clamp 370. Moreover, the ramped component 380 may have an enlarged inner diameter at the second end 382. An edge of the inner ramped surface 387 proximate the second end 382 may engage the outer conductor 314 at a point where the outer conductor 314 can ride up a distance and potentially fold over itself when it is compressed/clamped between the ramped component 380 and the clamp 370 when the cable 310 is axially advanced into the connector body 320.

Embodiments of the first end 381 of the ramped compression component 380 may provide an engagement surface to physically contact/engage the socket 346. The engagement surface of the insert component 380 may act as a driver of the socket 346, and ultimately the contact 340, further into the opening 359 of the insulator body 350 when the connector is axially compressed and moved to a closed position. In addition, the ramped component 380 may be made of non-conductive materials, such as a plastic material. The ramped component may be made of a material that exhibits malleable and/or conformal properties when compressed. In alternative embodiments, the ramped compression component 380 may be made of conductive materials, such as metals including copper, brass, nickel, aluminum, steel, and the like, and can be plated. Further, the ramped component 380 may also be plastic with a conductive metal coating.

Embodiments of connector 300 may also include an insert 355. The insert 355 may be disposed within the connector body between an outer surface 384 of the compression component 380 and the inner surface 323 of the connector body 320. An engagement surface 356 of the insert 355 may be configured to physically engage lip 328 of the connector body 320 when in the second, closed position to prevent, stop, or at least hinder further axial movement of the components within the connector body 320. Embodiments of the insert may be conductive or non-conductive. For instance, the insert 355 may be comprised of metal. Alternatively, the insert 355 may be comprised of a plastic material. Embodiments of the insert 355 may be formed of metals or polymers or other materials that would facilitate a rigidly formed body. Manufacture of the insert 355 may include casting, extruding, cutting, turning, tapping, drilling, injection molding, blow molding, or other fabrication methods that may provide efficient production of the component.

Furthermore, embodiments of connector 300 may include a clamp 370. Embodiments of the clamp 370 may be a clamp, a seizing element, an outer conductor-cable engagement member, a clamp driver, an internally threaded member, or any generally annular member configured to compress, threadably engage, and/or clamp an outer conductor 314. In some embodiment, the clamp 370 may also threadably engage, compress, or otherwise engage a portion of the cable jacket 312. Embodiments of the clamp 370 may be a solid, generally annular, internally threaded member. For example, embodiments of the clamp 370 may be an annular member having a first end 371 and a second end 372, an inner surface 373, an outer surface 374, and a generally axial opening therethrough. Embodiments of clamp 370 may also include one or more slots to provide some resiliency, or may include a continuous, uninterrupted revolution across the axial distance of the clamp. Further embodiments of the clamp 370 may be slotted proximate or otherwise near the second end 372, such that the threaded end of the clamp 370 engaging the cable 310 may be slotted or flexible, while the rest of the clamp 370 does not include slots. The internal threads of the clamp 370 may match or correspond to a helical or spiral configuration of the outer conductor 314 of the cable 310. The clamp 370 may be disposed within the connector body 320; however, a portion of the clamp 370 may extend beyond the connector body 320 proximate the second end 302 of the connector in the open position. In some embodiments of connector 300 where the compression member is configured to enter the internal opening of the connector body 320, clearance between the inner surface 323 of the connector body 320 and the outer surface 374 of the clamp 370 may be necessary to allow axial insertion of the compression member 360; however, clamp 370 may include a protrusion that can extend to the inner surface 323 of the connector 320 to establish a press-fit relationship with the connector body 320.

Furthermore, embodiments of the clamp 370 may include a rearward engagement surface 378 configured to engage a drive surface of the drive member 390 during axial compression of the compression member 360 which may facilitate axial displacement of the clamp 370 (and the cable 310 threadably engaged therewith) through the connector body 320.

Proximate the second end 372, the clamp 370 may include a cavity for receiving, accommodating, accepting, etc. a seal member 3110. The cavity of the clamp 370 may be defined by an inner radial wall 375 and an inner wall 376. The inner wall 376 may extend axially from a body portion of the clamp 370 to form the cavity to accept the seal member 3110. Moreover, with reference to FIG. 3, embodiments of the clamp 370 may include one or more slots 377*a* to receive a protrusion 3115 of the seal member 3110. Embodiments of the slots 377*a* may be milled slots, bores, openings, keyways, voids, and the like. The slots 377*a* may start from the second end 372 and axially extend toward the first end 371 a distance. The cooperation between the protrusion 3115 of the seal member 3110 and the slots 377*a* of the clamp 370 may prevent, stop, or at least hinder the seal member 3110 from rotating with the outer conductor 314. Conversely, the cooperation between the slots 377*a* of the clamp 370 and the protrusions 3115 on the seal member 3110 may allow the seal member 3110 to rotate with the clamp 370.

Moreover, proximate the first end 371, the clamp 370 may include a forward engagement surface 377. The forward engagement surface 377 of the clamp 370 may oppose the ramped surface 387 of the ramped component 380. In other words, the forward engagement surface 377 of the clamp 370 may correspond to and cooperate with the inner ramped surface 387 of the ramped component 380 such that the outer conductor 314 may be clamped, seized, sandwiched, etc. between the surfaces 377, 387. Embodiments of the forward engagement surface 377 of the clamp 370 may be referred to as a second surface, or second compression surface, wherein the second surface is configured to axially compress against the outer conductor 314 which may have been flared out by the first surface, or inner ramped surface 387 of the ramped component 380. The forward engagement surface 377 of the clamp 370 may be ramped or perpendicular or substantially perpendicular with respect to a central axis of the connector 300.

Accordingly, the clamp 370 may threadably engage the outer conductor 314 of the cable 310. Embodiments of the clamp 370 may be made of conductive materials, such as metal. In other embodiments, the clamp 370 may be comprised of non-conductive materials. For example, the clamp 370 may be made of plastics, composites, hard plastics, or other insulating material that may form a rigid, yet potentially compliant body. Manufacture of the clamp 370 may include casting, extruding, cutting, turning, drilling, compression molding, injection molding, spraying, or other fabrication methods that may provide efficient production of the component.

Figure 7:
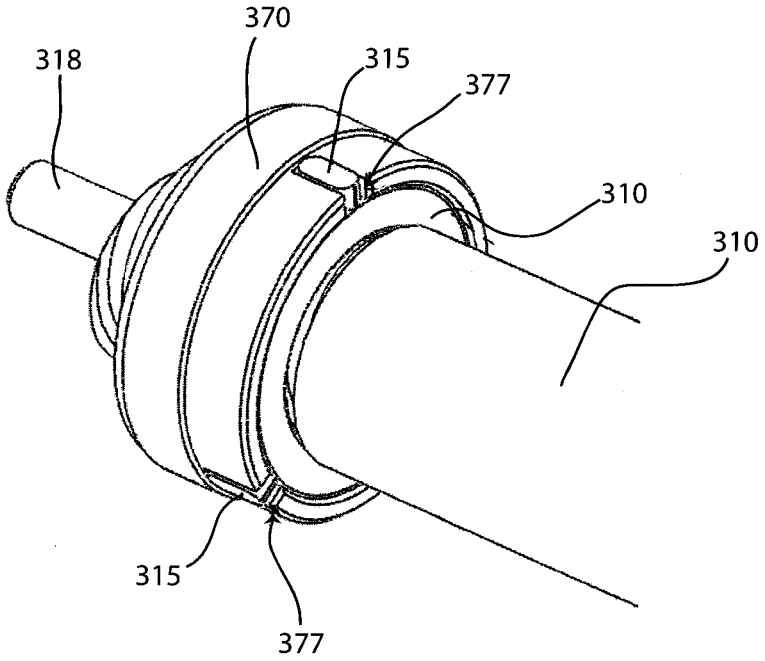
FIG. 7 depicts a perspective view of an embodiment of a seal member in cooperation with an embodiment of a clamp, operably attached to the coaxial cable.
Figure 8:
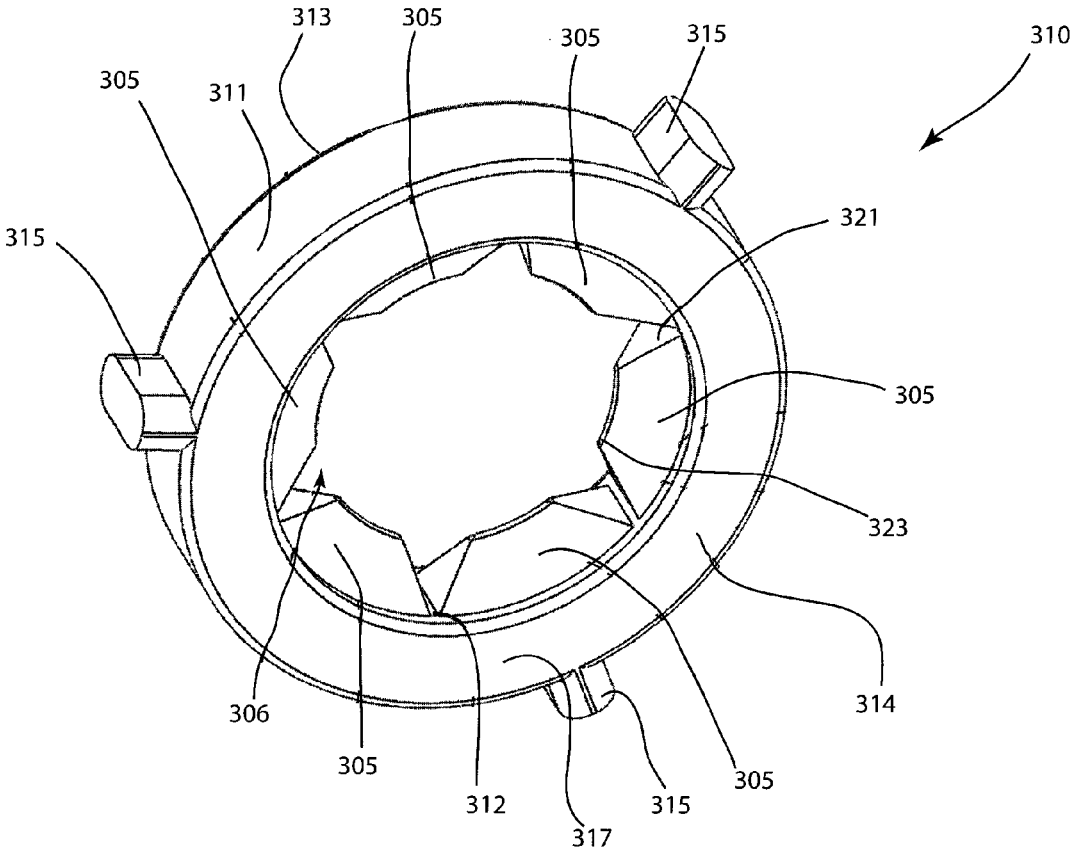
FIG. 8 depicts a perspective view of an embodiment of the seal member.

Referring still to FIG. 5, and with additional reference to FIGS. 7 and 8, embodiments of the connector 300 may include a seal member 3110. Embodiments of seal member 3110 may be a seal, an elastomeric thread seal, a rubber thread seal, a sealing element, a rubber seal component, and the like, that may be disposed within a pre-assembled connector 300. Upon compressed of a compression member 360, the seal member 3110 may fill, or further fill, the valleys 319 of the outer conductor 314, creating a seal completely around the helical outer conductor 314. In other words, the seal member 3110 may be configured to create an environmental seal around an outer conductor 314 of the coaxial cable 310 when the connector is in a closed position; the seal member may also effectuate an environmental seal around the outer conductor 314 when in an open position. Furthermore, embodiments of the seal member 3110 may comprise a body portion 3117 defined by a first surface 3113 that may face towards the first end 301 of the connector 300 when the connector is an assembled position, a second surface 3114 that may face towards a second end 302 of the connector 300 when the connector 300 is in the assembled position, an outer diameter surface 3111, and an inner diameter surface 3112, and may be a generally annular member having a generally axial opening therethrough. Embodiments of the seal member may include one or chamfers or beveled edges along the first and second surface 3113, 3114.

Moreover, embodiments of the seal member 3110 may include a plurality of flexible segments 3105 configured to conform and adjust to seal against the helical threads of the outer conductor 314 as the seal member 3110 is either driven axially over or threaded onto/over the outer conductor 314 of the cable 310 during assembly of the connector 300 and axial compression of the compression member 360. Embodiments of the flexible segments 3105 may be inner portions, inner segments, flexible teeth, The flexible segments 3105 may be positioned along the inner diameter surface 3112 and may project radially inward a distance sufficient to engage an outer surface of the outer conductor 314 of a cable 310 attached to connector 300; the segments 3105 may fill the deep corrugations or valleys 319 of the outer conductor 314. Embodiments of the inner segments 3105 may have a triangular cross-section or profile, wherein a thickness 3121 of the segment 3105 may be greater closer to the inner diameter surface 3112 than at a distal end 3123 of the segment 3105. The difference in thickness of the segment 3105 may be gradual, and may promote less resistance to deflection at the distal end 3123 than at the inner diameter surface 3112. Additionally, embodiments of the flexible segments 3105 may be structurally integral with the seal member 3110 so as to form a one-piece sealing member. Embodiments of the seal member 3110 may function to create a seal regardless of its orientation. For instance, the plurality of inner segments 3105 can flex and conform to the thread pattern of the outer conductor 314, allowing the seal member 3110 to be made the same for other connectors, regardless of the thread pattern of the clamp used in the connector, or the exact thread pattern helical outer conductor, and functions regardless of the orientation of the seal with respect to the clamp.

With continued reference to FIGS. 5 and 7-8, embodiments of flexible segment 3105 may be displaced, deflected, compressed, twisted, torqued, etc., in various axial and radial directions, including opposing axial and radial directions with respect to the other segments 3105 of the seal member 3110, by the cable 310 to correspond to the helical pattern of the outer conductor thread pattern. For instance, one of the flexible segments 3105 may be displaced in a direction towards the first end 301 of the connector 300, while another one of the flexible segments 3105 may be displaced or otherwise moving towards the second end 302 of the connector 300 at the same time during assembly or compression of the connector 300. Further, flexible segments 3105 may first be displaced towards the first end of the connector 300 as a forward edge of a helical corrugation of the outer conductor 314 passes through the opening of the seal member 3110, and when the forward edge of the corrugation clears, the segment 3105 may attempt to return to a rest position, wherein it may engage and seal against a portion of the outer conductor 314. Accordingly, embodiments of the seal member 3110 may be an active seal with a very high aspect ratio; the radial stroke allows the seal member 3110 to have a diameter in the open position of the connector 300 which allows a cable 310 or any other tube to be inserted without cutting or tearing the seal member 3110.

Furthermore, the seal member 3110 may cooperate with the clamp 370, as shown in FIG. 7. For instance, embodiments of the seal member 3110 may be disposed within a cavity of the clamp 370 defined by the inner radial wall 375 and the inner wall 376. In this position, the seal member 3110 may be engaging and sealing against the threads of the outer conductor 314. Embodiments of the seal member 3110 may include one or more protrusions 3115 positioned along the outer diameter surface 3111 to cooperate with one or more slots 377*a* of the clamp 370, as shown in FIG. 7. In an exemplary embodiment, the seal member 3110 may include three protrusions 3115 for structural cooperation with three slots 377*a* located on the clamp 370. Embodiments of the protrusions 3115 may be nubs, arms, bumps, protrusions, and the like, that extend radially outward from the outer diameter surface 3111. The cooperation between the protrusion 3115 of the seal member 3110 and the slots 377*a* of the clamp 370 may prevent the seal member 3110 from rotating with the outer conductor 314; conversely, the cooperation between the slots 377*a* of the clamp 370 and the protrusions 3115 on the seal member 3110 may allow the seal member 3110 to rotate with the clamp 370 during attachment of the connector 300 to the cable 310.

Referring back to FIG. 5, embodiments of the connector 300 may include a drive member 390. The drive member 390 may be a generally annular tubular member. The drive 390 may be a solid sleeve collar and may be disposed within the connector 300 proximate or otherwise near the clamp 370 and the collar 395. For instance, drive member 390 may be disposed around the cable jacket 312 of the coaxial cable 310 when the cable 310 enters the connector 300. Moreover, embodiments of the drive member 390 may include an annular protrusion 391 having a forward facing surface 391*a* and a rearward facing surface 391*b*. The forward facing surface 391*a* of the annular protrusion 391 may be configured to engage the rearward engagement surface 378 of the clamp 370, acting as a driver to axially displace the clamp 370 through the inner opening of the connector body 320 towards a first end 321 of the connector body 320. Embodiments of the drive member 390 may be made of conductive or non-conductive materials. In one embodiment, the drive member 390 is comprised of a metal material.

Embodiments of connector 300 may further include collar 395. Embodiments of the collar 395 may be a generally annular tubular member. The collar 395 may be a solid sleeve collar and may be disposed within the connector 300 proximate or otherwise near the drive member 390 and the compression member 360. For instance, collar 395 may be disposed around a portion of the drive member 390 and a portion of a cable seal member 399; the cable seal member 399 may form a seal around the cable 310 as the compression member 360 is axially compressed due to deformation and compression of the seal 399 to prevent the ingress of environmental elements, such as rainwater. Moreover, embodiments of the drive member 390 may include a forward facing surface 398*a* and a rearward facing surface 398*b*. The forward facing surface 398*a* may be configured to engage the rearward facing surface 391*b* of the drive member 390, acting as a driver to axially displace the drive member 390 and clamp 370 through the inner opening of the connector body 320 towards a first end 321 of the connector body 320. Embodiments of the collar 395 may be made of conductive or non-conductive materials. In one embodiment, the collar 395 is comprised of a metal material.

Figure 9:
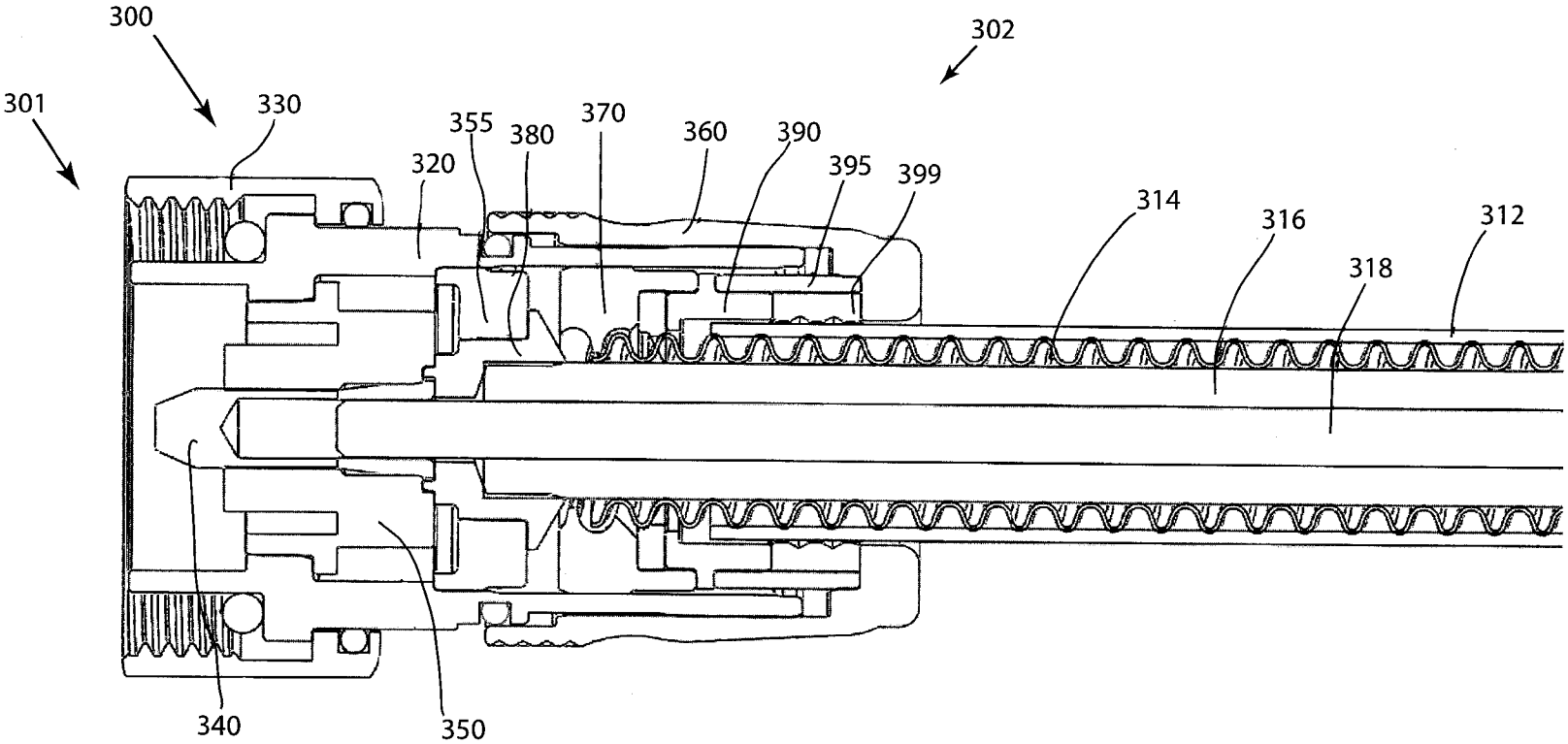
FIG. 9 depicts a cross-sectional view of an embodiment of the connector in the closed position operably attached to the coaxial cable.

With continued reference to FIG. 5, and additional reference now to FIG. 9, embodiments of connector 300 may also include a compression member 360. The compression member 360 may have a first end 361, a second end 362, an inner surface 363, and an outer surface 364. The compression member 360 may be a generally annular member having a generally axial opening therethrough. The compression member 360 may be configured to be engageable with the second end 322 of the connector body 320. For instance, the compression member 360 may be axially compressed (e.g. via an axial compression tool) over, or into in some embodiments, the connector body 320. Proximate or otherwise near the first end 361, the compression member 360 may include an internal lip 368 configured to engage/contact the rearward facing surface 398*b* of the collar 395 during axial compression, or as the connector 300 moves from an open position, as shown in FIG. 5, to a closed position, as shown in FIG. 9. For instance, the compression member 360 may axially slide towards the first end 321 of the connector body 320 to contact the rearward facing surface 398*b* to help drive the clamp 370 threadably engaged with the cable 310 towards the first end 1 of the connector 300. The compression member 360 may further include an annular groove that may house, retain, etc., a sealing member, such as an elastomeric O-ring or other deformable sealing member. Furthermore, it should be recognized, by those skilled in the requisite art, that the compression member 360 may be formed of rigid materials such as metals, hard plastics, polymers, composites and the like, and/or combinations thereof. Furthermore, the compression member 360 may be manufactured via casting, extruding, cutting, turning, drilling, knurling, injection molding, combinations thereof, or other fabrication methods that may provide efficient production of the component.

Figure 10:
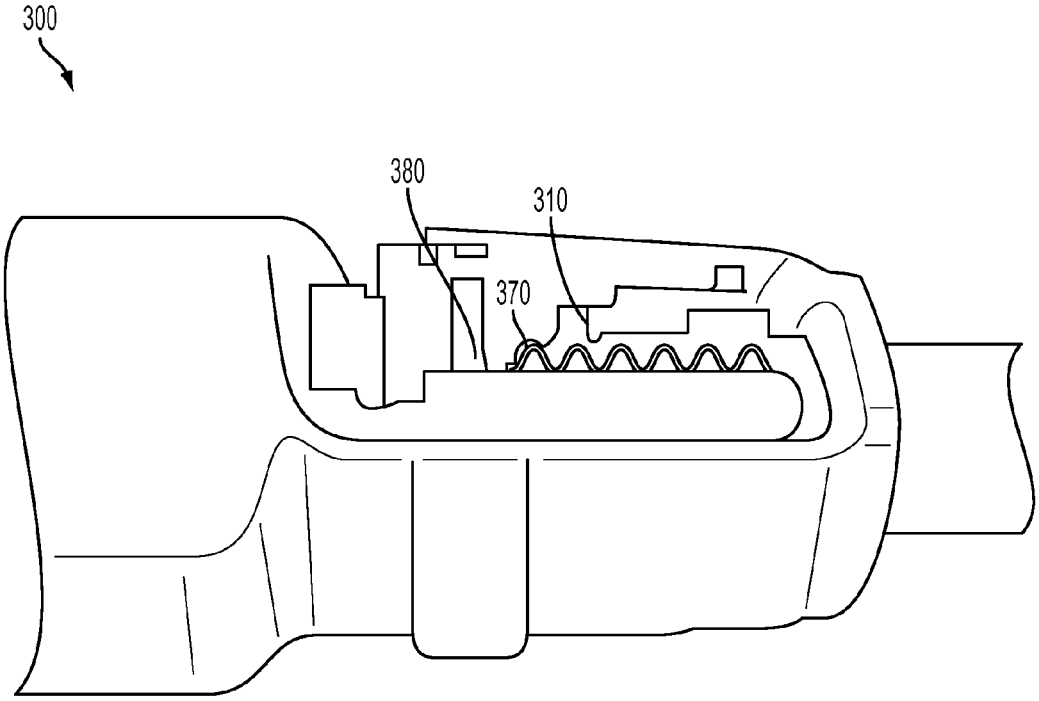
FIG. 10 depicts a perspective, cut-away view of an embodiment of the connector in a closed position, wherein the seal member forms an environmental seal around an embodiment of an outer conductor.

Referring now to FIGS. 5 and 9-10, the manner in which connector 300 may move from an open position to a closed position, which can form a seal, or increase the effectiveness of the seal, around the outer conductor 314 will now be described. FIG. 5 depicts an embodiment of the connector 300 in an open position. The open position may refer to a position or arrangement wherein the center conductor 318 of the coaxial cable 310 is not clamped or captured by the socket 346 of contact 340, or only partially/initially clamped or captured by the socket 346. The open position may also refer to a position prior to axial compression of the compression member 360. The cable 310 may enter the generally axially opening of the compression member 360 and connector body 320 as the preassembled connector 300 is drawn over the cable 310. Once the clamp 370 is positioned over or proximate the exposed outer conductor 314 of the cable 310, the connector 300 may be rotated or otherwise threaded to threadably engage the cable 310. For example, the threaded portion 375 of the clamp 370 may threadably engage the cable jacket 312 when the connector 300 is rotated or twisted about the cable 310. Alternatively, in other embodiments, the coaxial cable 310 may be rotated or twisted to provide the necessary rotational movement to mechanically threadably engage the clamp 370. The threadable engagement between the cable 310 and the clamp 370 may establish a mechanical connection between the connector 300 and the coaxial cable 310. In addition, threadably engaging the cable 310 with the internal clamp 370 can prevent unwanted movement and shifting of the cable 310, thereby resulting in desirable PIM results. When the connector 300 is threadably engaged with the cable 310, the seal member 3110 may rotate along with the clamp 370 and allow the cable 310 to be inserted through the seal member 3110. In other words, the seal member 3110 can be threaded onto the outer conductor 314. Because the seal member 3110 includes a plurality of flexible segments 3105, the thread or pitch of the helical outer conductor simply deflects the flexible segments 3105 and enters the valleys 319 of the outer conductor 314 during threadable engagement of the connector 300 to the cable 310.

FIGS. 9 and 10 depict an embodiment of a closed position of the connector 300. The closed position may refer to a position or arrangement of the connector 300 wherein the center conductor 318 is fully clamped or accepted by the socket 346 of contact 340 and the contact 340 is driven within the opening 359 of the insulator body 350, the outer conductor 314 of the coaxial cable 310 is clamped/seized between the clamp 370 and the ramped component 380, or a combination thereof. The closed position may be achieved by axially compressing the compression member 360 into or over the connector body 320. The axial movement of the compression member 360 can axially displace the cable 310 and other components disposed within the connector body 320 because the compression member 360 can mechanically engage the connector 300 components at one or more locations. For instance, the internal lip 368 of the compression member 360 may be configured to mechanically engage the rearward facing surface 398*b* of the collar 395 to drive the connector components to a closed position. One or more of the mechanical engagement between the compression member 360 and the connector 300 components may cause the axial displacement of the components when the compression member 360 is axially compressed.

As the compression member 360 is axially compressed and the connector 300 moves to a closed position, the outer conductor 314 may be clamped, sandwiched, retained, seized, etc., between the clamp 370 and the ramped component 380. Moreover, the movement from the open position, shown in FIG. 5, to a closed position, as shown in FIGS. 9 and 10, may result in compression of the seal member 3110 deep into the valleys 319 of the outer conductor 314 to provide an environmental seal around the outer conductor 314, within the connector 300. For instance, regardless of the orientation of the seal member 3110, when a lead thread comes, the segments 3105 find open grooves between corrugations in the conductor 314 and conform to the helical pattern of the outer conductor 314. Thus, any moisture traveling down the helical outer conductor 314 toward the first end 1 of the connector 300 can be stopped and prevented from continuing to travel down the conductor 314.

Axial compression of the compression member 360, as shown in the closed position, may irreversibly engage the cable 310, including the center conductor 318 and the outer conductor 314. For instance, axial compression of the compression member 360 may irreversibly engage/seize the outer conductor 314 between the internal ramped surface 387 of the ramped component 380 and the forward surface 377 of the clamp 370. In addition, the axial compression may also irreversibly seize the center conductor 318 because the socket 346 of the electrical contact 340 has been axially compressed into the opening 359 of the insulator body 350. Irreversible engagement of the cable 310 can mean that movement of the compression member 360 in the opposite direction (i.e. towards the second end 302 of the connector) after axial compression would not loosen the mechanical engagement between the seizing and/or clamping connector 300 components and the center conductor 318 and the outer conductor 314. For example, once the compression member 360 is compressed, the center conductor 318 may remain securely engaged within the socket 346 that is securely retained within the opening 359 of the insulator body 350, which is securely retained within the connector body 320, even if the compression member 360 is removed or otherwise disengaged. Likewise, once the compression member 360 is compressed, the outer conductor 314 can remain securely engaged/pinched between the internal ramped surface 387 of the ramped component 380, which is securely retained within the connector body 320 at a location closer to the first end 301 of the connector than prior to axial compression, and the forward surface 377 of the clamp 370, which is securely retained within the connector at a location closer to the first end 301 of the connector 300 than prior to compression, while also still threadably engaged with the cable jacket 312, even if the compression member 360 is removed or otherwise disengaged. Accordingly, axially compressing a compression member can securely retain electrical-mechanical components within a connector, such as connector 300, in a permanent fashion, so as to ensure proper and secure contact between conductive components, regardless if the connector 300 is jostled, mishandled, and/or partially disassembled, such as removal of the compression member 360, or otherwise subjected to use common to coaxial cable connectors. Permanent fashion and irreversible engagement does not imply that it is absolutely impossible for the connector components to relinquish mechanical engagement of the cable 310, including the center conductor 318 and the outer conductor 314, if subjected to extreme forces, but can mean that the connector components may not relinquish mechanical engagement with the cable 310 if subjected to more than ordinary forces commonly experienced by connectors installed or otherwise used in the field of wireless and cellular communication equipment. Thus, this superior engagement of the cable 310 is done simply by attaching a preassembled connector, such as connector 300, onto a prepared end of a coaxial cable 310, and axially compressing a compression member 360 using a compression tool known to those having skill in the art.

Referring now to FIGS. 1-10, a method of providing a seal around an outer conductor may be accomplished by disposing the seal member within the connector.

While the present invention has been described with reference to a number of specific embodiments, it will be understood that the true spirit and scope of the invention should be determined only with respect to claims that can be supported by the present specification. Further, while in numerous cases herein wherein systems and apparatuses and methods are described as having a certain number of elements it will be understood that such systems, apparatuses and methods can be practiced with fewer than the mentioned certain number of elements. Also, while a number of particular embodiments have been described, it will be understood that features and aspects that have been described with reference to each particular embodiment can be used with each remaining particularly described embodiment.

What is claimed is:

1. A seal member disposed within a coaxial cable connector comprising:

an annular body portion having an outer diameter surface and an inner diameter surface; and a flexible protrusion extending radially inward from the inner diameter surface, the flexible protrusion separated by at least one stress relieving slit to define a plurality of flexible segments;

wherein the flexible segments are configured to conform to a helical outer conductor and fill a valley of the helical outer conductor, thereby effectuating an environmental seal around the helical outer conductor.

2. The seal member of claim 1, further comprising a plurality of protrusions extending from the outer diameter surface are configured to cooperate with a plurality of slots in a clamp of the coaxial cable connector.

3. The seal member of claim 1, wherein the plurality of flexible segments have a triangular profile.

4. The seal member of claim 1, wherein the number of of flexible segments is at least six.

5. The seal member of claim 1, wherein a thickness of the plurality of flexible segments is greater closer to the inner diameter surface than at a distal end of the plurality of flexible segments.

6. The seal member of claim 5, wherein a difference in the thickness of the plurality of flexible segments is gradual, and promotes less resistance to deflection at the distal end than at the inner diameter surface.

7. The seal member of claim 1, wherein the seal member is comprised of an elastomeric material.

8. A coaxial cable connector comprising:

a connector body having a first end and a second end;

a clamp disposed within the connector body, the clamp having a cavity;

a seal member disposed within the cavity of the clamp, the seal member having a flexible protrusion extending radially inwardly from an inner diameter surface of the seal member, the flexible protrusion separated by at least one stress relieving slit to define a plurality of flexible segments; and a compression member operably attached to the second end of the connector body;

wherein axial compression of the compression member towards the connector body facilitates an environmental seal against an outer conductor of a coaxial cable.

9. The coaxial cable connector of claim 8, wherein the plurality of flexible segments conform to a helical pattern of the outer conductor of the coaxial cable.

10. The coaxial cable connector of claim 8, wherein the cavity of the clamp is defined by an inner radial wall and an inner wall, the inner wall extending axially from a body portion of the clamp.

11. The coaxial cable connector of claim 8, wherein the seal member includes one or more protrusions extending from an outer diameter surface of the seal member, the one or more protrusions cooperating with a plurality of slots in the clamp.

12. The coaxial cable connector of claim 8, wherein the plurality of flexible segments have a triangular profile.

13. A coaxial cable connector for assembly via axial compression to a helical corrugated coaxial cable having a helical corrugated outer conductor, the coaxial cable connector comprising:

a connector body having a fastener end;

a sealing member configured to overlap a helical corrugated outer conductor, the sealing member having a radial thickness and a ridge seal, the sealing member further having a flexible protrusion extending radially inward from the ridge seal, the flexible protrusion separated by at least one stress relieving slit to define a plurality of flexible segments, each segment configured to extend into a helical groove of a helical corrugated outer conductor; and a compression member, the compression member axially advancing the sealing member relative to the connector body toward the fastener end of the connector body, wherein axial advancement of the compression member results in axial distortion of the sealing member and radial contact between the sealing member and the helical corrugated outer conductor.

14. The coaxial cable connector of claim 13, wherein, upon radially inward expansion of the sealing member, the plurality of flexible protrusions make redundant sealing contact with the helical corrugated outer conductor.

15. The coaxial cable connector of claim 13, wherein axial advancement of the sealing member produces sealing contact with a body cavity.

16. The coaxial cable connector of claim 13, wherein the flexible segment has a triangular profile.

17. A method of providing a seal around an outer conductor, comprising:

disposing a seal member within a coaxial cable connector, wherein the seal member includes an annular body portion having an outer diameter surface and an inner diameter surface, and a flexible protrusion extending radially inward from the inner diameter surface, the flexible protrusion separated by at least one stress relieving slit to define a plurality of flexible segments; and axially compressing the coaxial cable connector so that the plurality of flexible segments conform to a helical outer conductor and fill a valley of the helical outer conductor, thereby effectuating an environmental seal around the helical outer conductor.

18. The method of claim 17, wherein the plurality of flexible segments have a triangular profile.

19. The method of claim 17, wherein the coaxial cable connector comprises:

a connector body having a first end and a second end;

a clamp disposed within the connector body, the clamp having a cavity for accepting the seal member; and a compression member operably attached to the second end of the connector body.

* * * * *